US008112932B1

(12) United States Patent
Vollmer

(10) Patent No.: US 8,112,932 B1
(45) Date of Patent: Feb. 14, 2012

(54) TOOL FOR SINGLE HANDED RELOADING OF MUZZLE LOADING FIREARMS

(76) Inventor: Mickey S. Vollmer, Chesapeake, VA (US)

( * ) Notice: Subject to any disclaimer, the term of this patent is extended or adjusted under 35 U.S.C. 154(b) by 177 days.

(21) Appl. No.: 12/660,050

(22) Filed: Feb. 19, 2010

Related U.S. Application Data

(60) Provisional application No. 61/210,840, filed on Mar. 23, 2009.

(51) Int. Cl.
*F41C 9/08* (2006.01)

(52) U.S. Cl. ..... 42/90; 42/51

(58) Field of Classification Search ..... 42/51, 87, 42/90, 106; 89/1.3
See application file for complete search history.

(56) References Cited

U.S. PATENT DOCUMENTS 4,607,446 A * 8/1986 Scheuring ..... 42/90
5,109,623 A * 5/1992 French ..... 42/90
5,182,412 A * 1/1993 Mazza ..... 42/90
6,637,143 B1 10/2003 Wykle
6,672,476 B2 * 1/2004 Cash et al. ..... 221/311
6,865,840 B2 * 3/2005 Kanyuck et al. ..... 42/90
7,249,433 B2 7/2007 Wilson
7,451,563 B1 11/2008 McKnight
2006/0162218 A1 * 7/2006 Church ..... 42/51

* cited by examiner

*Primary Examiner* — Bret Hayes
(74) *Attorney, Agent, or Firm* — James Creighton Wray

(57) ABSTRACT

A multipurpose tool includes four distinct tools and two containers which are used in the charging and priming of a modern muzzle loading firearm, and following discharge, removal of spent or unfired primers. The components include a water-resistant chamber for containing cartridges or propellant powder charge pellets and bullets of various calibers, a water-resistant chamber for protecting a pre-positioned primer, an integrated and extensible primer removal tool, an integrated and extensible primer retaining and insertion tool for quick primer removal and replacement, an integrated bullet starter, an integrated universal ramrod T-handle adapter, removable water-resistant storage chamber end caps and lanyards for loss prevention. The replaceable primer tool can accommodate removal, storage and insertion of multiple types of primers.

15 Claims, 10 Drawing Sheets

TOOL FOR SINGLE HANDED RELOADING OF MUZZLE LOADING FIREARMS

This application claims the benefit of U.S. Provisional Application No. 61/210,840, filed Mar. 23, 2009, which is hereby incorporated by reference in its entirety.

SUMMARY OF THE INVENTION

It is an object of this invention to provide a new and novel reloading tool that includes water resistant containers to store pelletized powder a bullet and a primer, as well as all of the ancillary tools typically used to facilitate the loading or reloading of modern muzzle-loading firearms. It is further the object of this invention to reduce the time required to reload modern muzzle-loading firearms with a tool that is weatherproof and that can be managed and manipulated with one hand.

In an illustrative, non-limiting embodiment this invention comprises an invention that embodies all of the tools and containers necessary to facilitate the very rapid loading or reloading a modern muzzle-loading firearm with one hand, while the shooter's other hand secures the firearm. The inventinon includes four distinct tools and two containers that are used in the charging and priming of a modern muzzle-loading firearm, as well as a primer removal tool, which is used in the removal of a spent or unfired primer thus allowing the shooter to reload without ever having to take his hands off of the muzzleloader. This invention dramatically reduces the time necessary to reload a muzzle-loading firearm as well as the amount of time cartridge components are exposed to adverse weather conditions during the reloading process.

The components of the invention include a water resistant chamber for containing propellant powder charge pellets and a bullet of various calibers, (hereinafter referred to as cartridges). A second water resistant chamber is provided for protecting a pre-positioned primer. An integrated and extensible primer removal tool, an integrated and extensible primer retaining and insertion tool provide for quick spent primer removal and replacement. An integrated bullet starter and an integrated universal ramrod T-handle adapter extend laterally from the tool. Removable water resistant chamber end caps seal the chambers. A lanyard attached to ends of the caps and to the tool extends around a user's neck for loss prevention. Several complete multipurpose tools and their caps may be connected to a single lanyard, or an individual lanyard may be used with a single multipurpose tool and its caps. In the latter case, several lanyards and tools may be carried by the user. The replaceable primer tool can be manufactured to accommodate removal, storage and insertion of multiple types of primers.

The new tool is loaded with a bullet and power in one storage chamber and a primer in the other chamber. A primer is pushed into the primer placement tool, and a cap is pushed on to close the primer chamber. The tool is inverted, and a bullet is placed in the longer storage chamber, followed by filling the chamber with a predetermined powder load, and that chamber is capped.

To load a muzzle loading firearm, the shoulder stock is placed on a level surface and a left handed of a right-handed person grips the barrel near the muzzle. The tool is held vertically in the right hand with the cap at the end of the powder and bullet chamber at the top. That cap is pushed from the chamber using the thumb of the right hand. The cap remains attached to the lanyard. The tool is raised and tipped, and the powder and the bullet are slid through the muzzle into the barrel. The tool is held in the right hand, and the bullet starter with a recessed end pushes the bullet further into the barrel. The bullet starter is pulled out of the barrel, and the tool is released to hang on its lanyard. A ramrod is withdrawn from its parallel holder adjacent the barrel with the right hand, inverted and pushed into the barrel.

The right hand again grips the tool and attaches the T-handle adapter on the tool to the end of the ramrod and pushes the bullet and powder home. The tool is released to hang on its lanyard, while the ramrod is pulled from the barrel and slid into its housing parallel to the barrel.

The right hand takes the tool and by sliding the primer recess cap with the thumb of the right hand, the cap on the primer end of the tool is removed. Using the thumb, the primer placement tool, which holds a primer, is slid outward from the multipurpose tool and into the primer receiver.

The left hand is slid downward along the barrel and lifts the firearm to a horizontal position for access to the primer receiver on the firearm.

If the firearm has been discharged previously, the primer removal fork that slides out with the placement tool is first used to remove the spent primer.

All of the containers and tools necessary to load or reload a modern muzzle loading firearm are included in the new single device, thus enabling firearm to be loaded or reloaded very quickly with one hand while the shooter's other hand secures the firearm. The novel elements of the invention reducing the likelihood of dropped or misplaced cartridge components or primers during the loading process. A bullet starter protrudes from the body of the tool. A universal ramrod T-handle is incorporated into the body of the new tool. A water resistant chamber contains the cartridge elements, propellant powder charge pellets and projectiles of various calibers and weights. A second water resistant chamber contains and stages a pre-positioned sealed primer. A replaceable and slideable integrated and extensible primer tool is used to facilitate quick primer removal and/or primer insertion.

Lanyard loops attached to the water resistant chamber end caps and to the main body of the tool reduce the potential for loss of the invention or its caps. The lanyard connects the end caps to the central body and is draped around the shooter's neck for easy access when in the field.

This invention is specifically designed for use with modern muzzle-loading firearms that utilize sealed primers and pelletized powder for hunting and for target shooting.

The primer is prepositioned in the primer insertion tool and is stored securely in a waterproof enclosure. The primer is as small as a pea and therefore the easiest item to drop or misplace while attempting to reload the rifle. The primer is often difficult to position on other primer tools while wearing gloves, which is not uncommon when hunting. Gloved shooters can easily use the invention to safely handle and reload a muzzle-loading firearm without removing their gloves or taking their hands off of their rifle. Prepositioning the primer on the primer tool and having the primer stored in the same unit is one of the most important elements of this invention because it dramatically reduces the time necessary to reload the rifle.

These and further and other objects and features of the invention are apparent in the disclosure, which include the above and ongoing written specification, with the claims and the drawings.

DETAILED DESCRIPTION OF THE DRAWINGS

FIGS. 1A-15 of the drawings show a multipurpose reloading tool 1 for use with modern muzzle loading firearms. The tool is constructed of a plastic material.

Figure 1A:
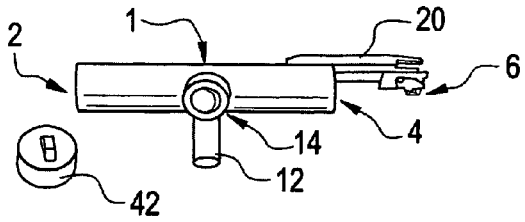
FIG. 1A shows a new integrated muzzle loading tool and one of the end caps.

FIG. 1A shows the tool 1 with a water resistant storage chamber 2 for a bullet and powder. A water resistant storage chamber 4 at the opposite end holds a new primer 6 attached to an extensible primer removal and insertion tool 20. A solid bullet starter 12 extends radially from the tool 1. A universal T-handle adapter 14 for a ramrod extends slightly from the tool at an angle to the bullet starter 12. Friction sealed storage chamber lids 42 and 44 fit on opposite ends of the tool 1 and provide water tight compartments for the powder charge and primer.

Figure 1B:
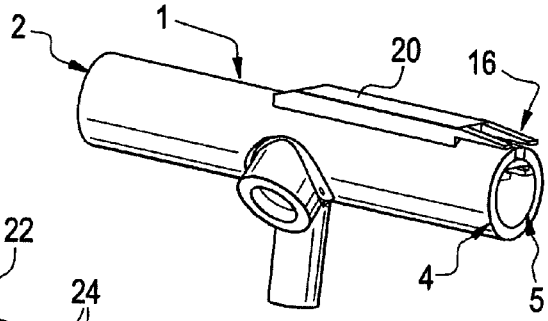
FIG. 1B is a perspective view of the new loading and primer removal and replacement tool with the primer tool retracted.

FIG. 1B is a perspective view of the tool 1 with the primer tool 20 retracted.

Figure 2:
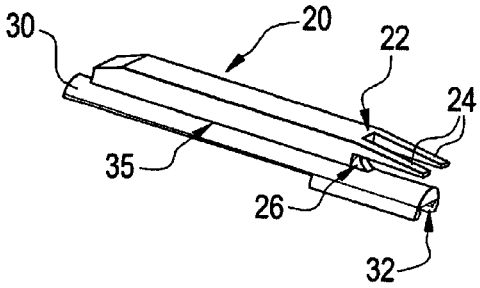
FIG. 2 is a perspective view of the primer tool.

FIG. 2 is a perspective view of the primer tool 20. The spent primer extractor 22 with an extractor fork 24 is connected by a throat 26 which fits in groove 16 in the primer storage chamber FIG. 1B 4. An internal member 30 has an outer curve 35, which matches the interior FIG. 1B 5 of the recess FIG. 1B 4 to hold the primer tool 20 assembled on the tool 1. A slot 32 in the end of internal member 30 holds the replacement primer.

Figure 3:
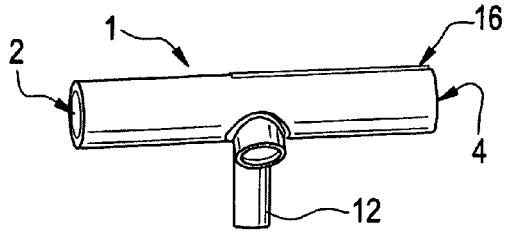
FIG. 3 shows a perspective view of the main body without the primer tool.

FIG. 3 is a perspective view of the main body of tool 1 with the primer tool 20 removed. The slot 16 is shown in the primer storage chamber 4.

Figure 4:
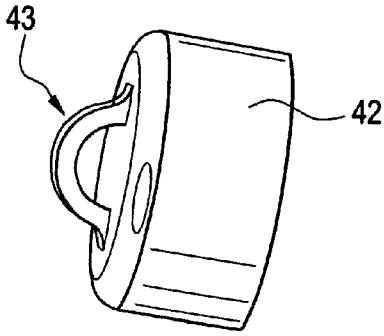
FIG. 4 shows a perspective view of a first device end cap with a lanyard loop.

FIG. 4 shows a perspective view of a first end cap 42 for the bullet and powder storage chamber 2. The cap 42 has a lanyard loop 43.

Figure 5:
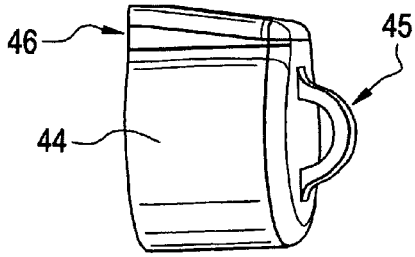
FIG. 5 shows a perspective view of a second device end cap with a lanyard loop.

FIG. 5 shows a perspective view of a second end cap 44 with a lanyard loop 45. The sloped portion 46 of the cap 44 receives the end of the primer removing tool 22 and fork 24 shown in FIG. 6 and the connecting throat 26 shown in FIG. 2.

Figure 6:
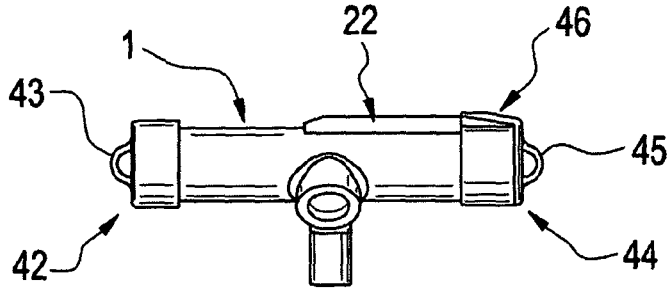
FIG. 6 shows a perspective view of the invention with water resistant caps in place.
Figure 7:
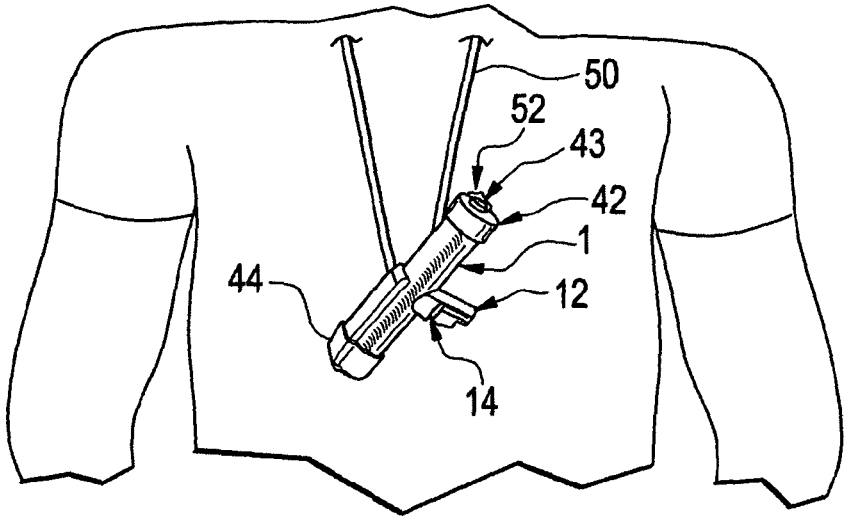
FIG. 7 shows a view of quick load hanging from shooter's neck, with the loader empty.

FIG. 6 is a perspective view of the tool 1 with the water resistant caps 42 and 44 in place. The tool 1 hangs on a lanyard 50 shown in FIG. 7. The lanyard 50 has extensions 52, 54 connected through loops 43 and 45 to hold caps 42 and 44.

Figure 8:
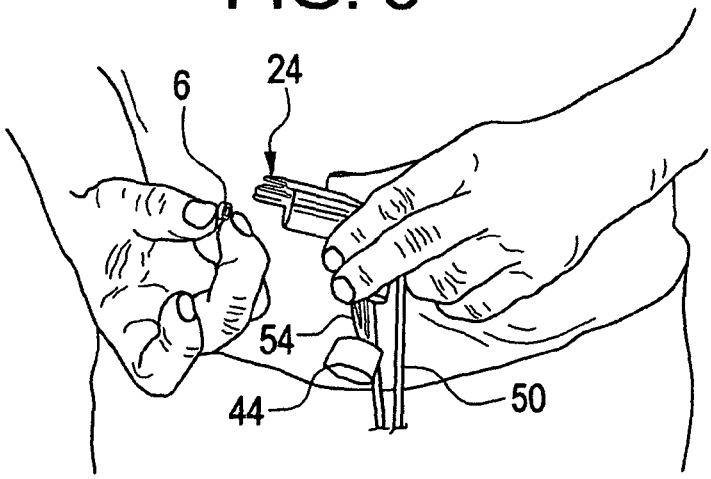
FIG. 8 new replacement primer prepositioned into primer retaining tool.
Figure 9:
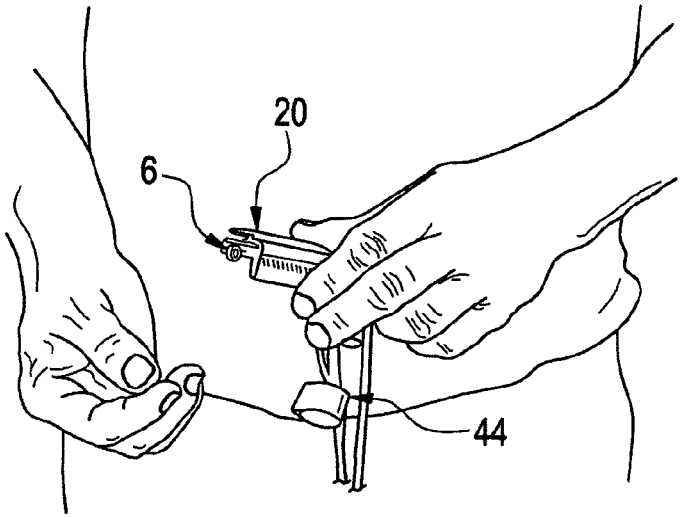
FIG. 9 shows a view of primer inserted and in place.
Figure 10:
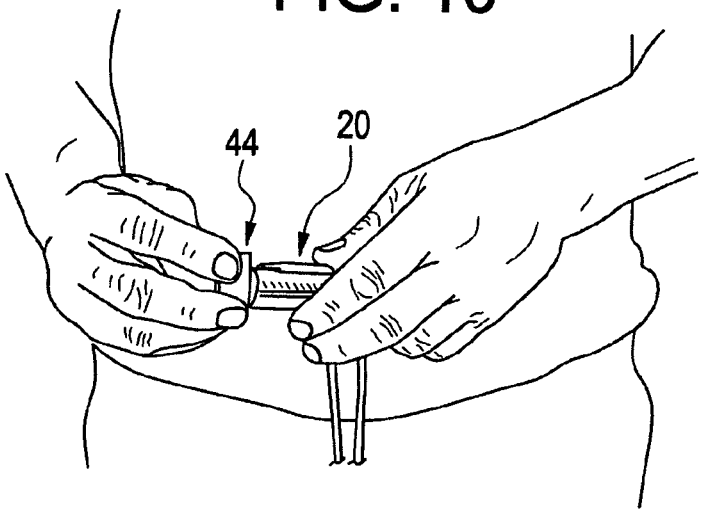
FIG. 10 show the primer tool end cap being replaced.
Figure 11:
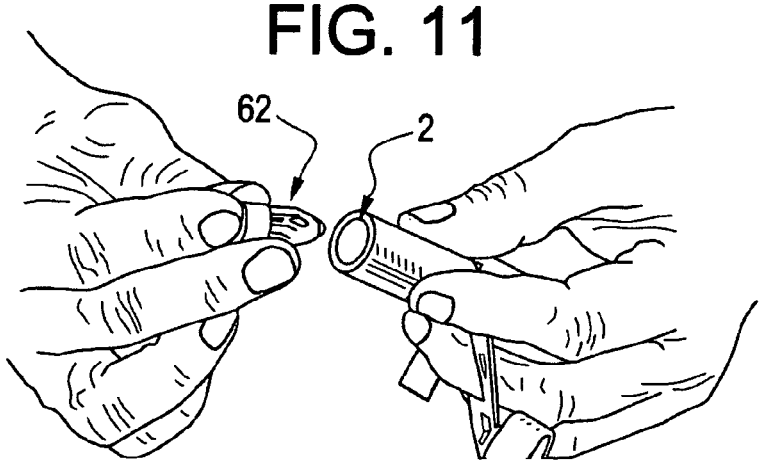
FIG. 11 shows a bullet being inserted in a cartridge storage end.
Figure 12:
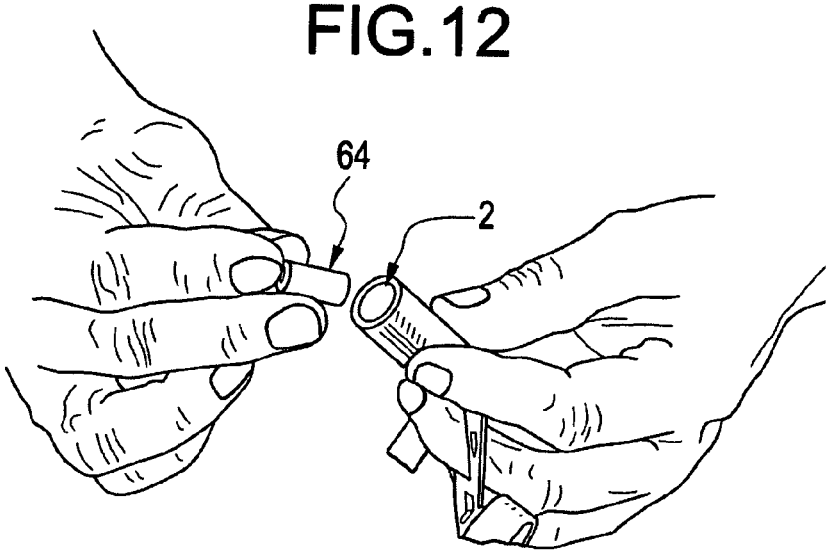
FIG. 12 shows pelletized powder being inserted following bullet into cartridge storage cavity.
Figure 13:
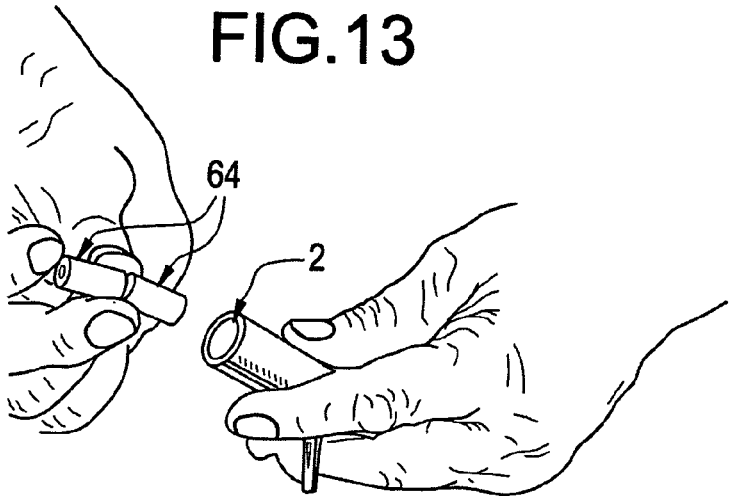
FIG. 13 shows a view of additional powder being stored for use a desired by shooter.
Figure 14:
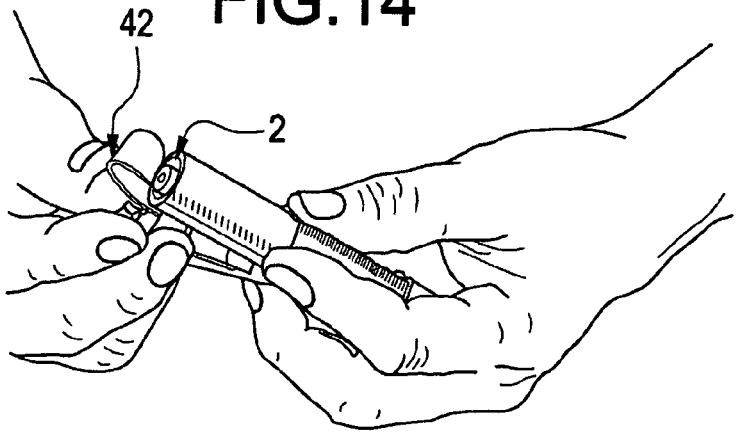
FIG. 14 shows a water tight storage cavity cap being replaced.

As shown in FIGS. 8-10, to prepare the invention for use, the user removes end cap 42, extends the primer insertion tool and inserts a primer 6 into the end slot 32 of the internal primer insertion tool member 30. The user then retracts the primer insertion tool and replaces cap 44 on the primer storage chamber 4. The user then removes cap 42 from the bullet and powder storage chamber 2 and inserts a bullet 62, as shown in FIG. 11 followed by powder pellets 64 as shown in FIGS. 12 and 13, and replaces cap 42 on the end of the storage chamber 2 as shown in FIG. 14. The invention is now ready for use.

Figure 15:
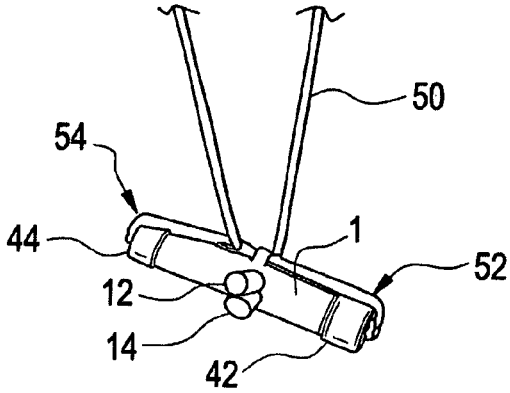
FIG. 15 shows the tool ready for use with bullet, powder and primer in place.

As shown in FIG. 15, the filled tool 1 hangs on lanyard 50, and the caps 42 and 44 are secured by extensions 52 and 54 of the lanyard.

Figure 16:
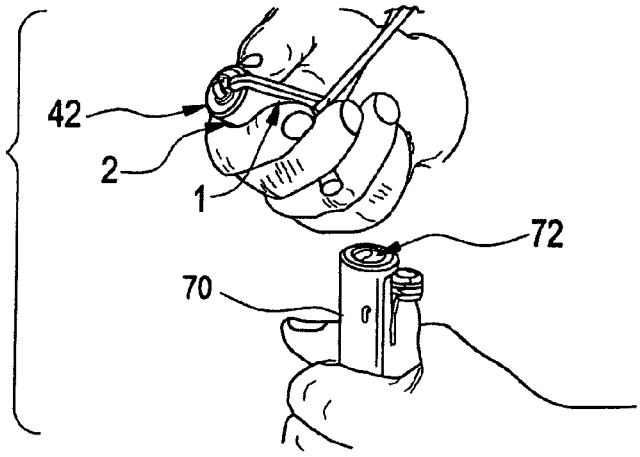
FIG. 16 shows the rifle being reloaded, using thumb to remove cartridge cavity watertight cap.
Figure 17:
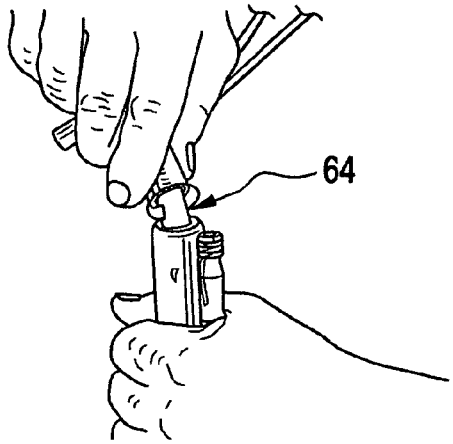
FIG. 17 shows dumped powder and bullet being stored in cavity barrel at muzzle end.
Figure 18:
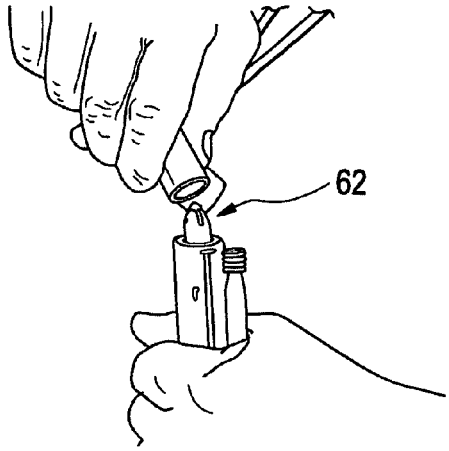
FIG. 18 shows the powder charges which fall to the bottom of the barrel, and the bullet sitting on top of barrel.

To use the device shown in FIGS. 1A-15, as shown in FIG. 16, while grasping an unloaded muzzle loading firearm 70 with one hand, with the muzzle 72 pointing upward, the shooter grasps the tool 1 with the free hand, with the thumb pointing toward the cartridge container end 2. Using the thumb as shown in FIG. 16, the shooter pushes the water resistant cap 42 off of the cartridge storage chamber 2 and carefully empties the contents of the container 2, the pelletized powder 64 and the bullet 62, into the muzzle 72 of the firearm 70 as shown in FIGS. 17 and 18. A properly sized bullet will fit snugly into the muzzle 72.

Figure 19:
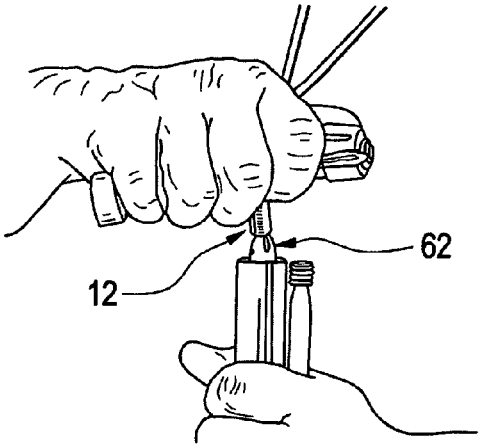
FIG. 19 shows the bullet starter being used to force bullet into the barrel.
Figure 20:
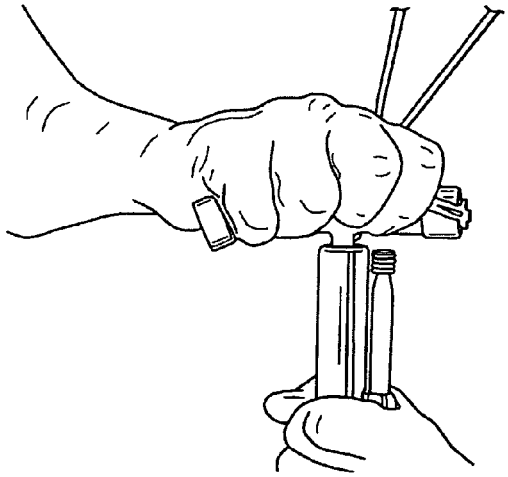
FIG. 20 shows a view of bullet starter full inserted into the barrel.
Figure 21:
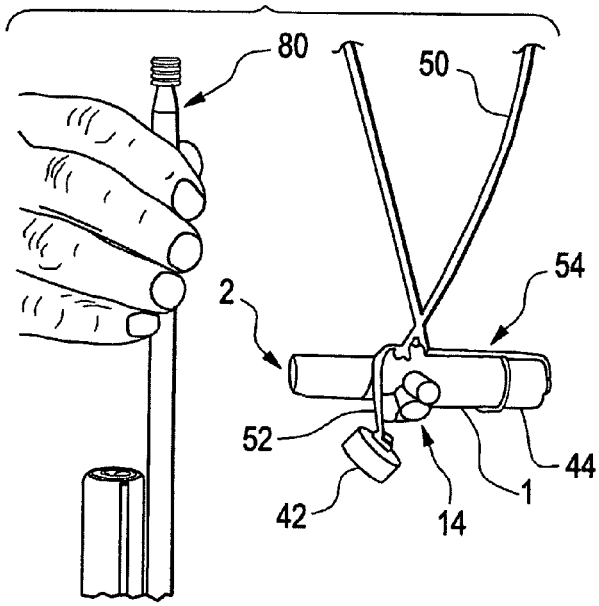
FIG. 21 shows the ramrod being removed from its stowage.
Figure 22:
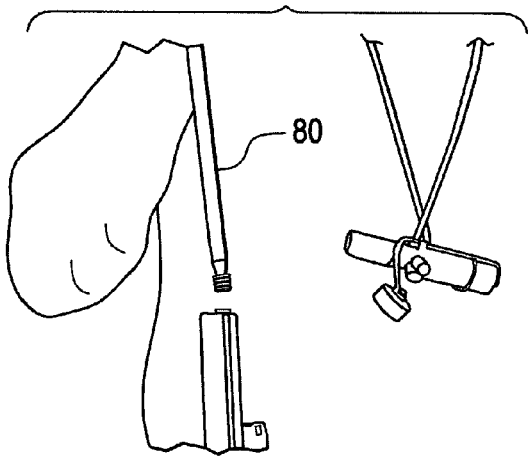
FIG. 22 show the bullet being pushed down into the barrel using the rifle's ramrod.

The shooter then utilizes the tool's bullet starter appendage 12 to start the bullet 62 into the rifled barrel 74 as shown in FIGS. 19 and 20. The shooter then releases the tool 1 to hang from its lanyard 52 while he retrieves the rifle's ramrod 80 a shown in FIG. 21. The shooter uses the ramrod 80 to seat the bullet firmly in the barrel on top of the pelletized powder charge as shown in FIG. 22.

Figure 23:
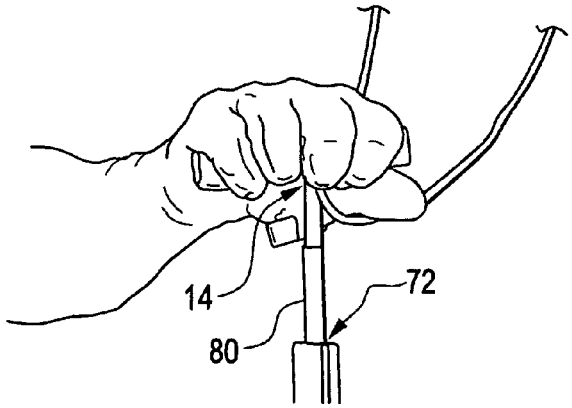
FIG. 23 shows the use of the Universal T handle to ensure that the bullet is fully seated on top of the powder charge.

To fully seat the bullet at the bottom of the barrel, the new multipurpose tool 1 includes a universal T-handle adapter 14 that can be positioned on top of the ramrod 80 to distribute the blunt pressure of the ramrod end and assure a proper bullet seat a shown in FIG. 23.

Figure 24:
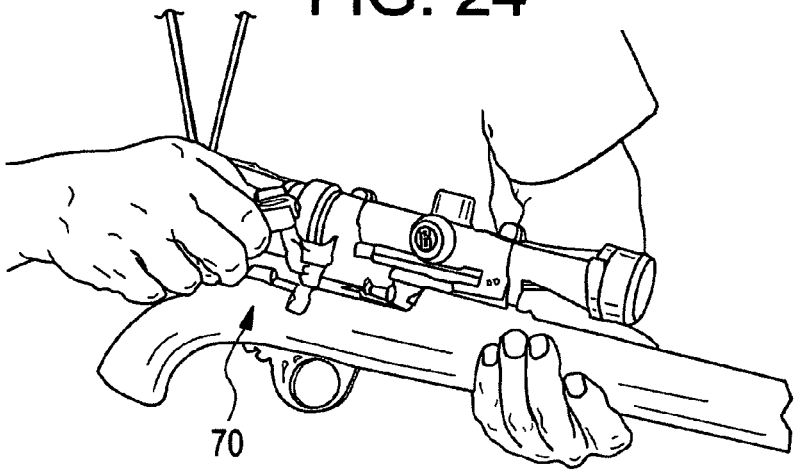
FIG. 24 shows the repositioning of the rifle to gain access to spent primer in beach end of rifle.
Figure 25:
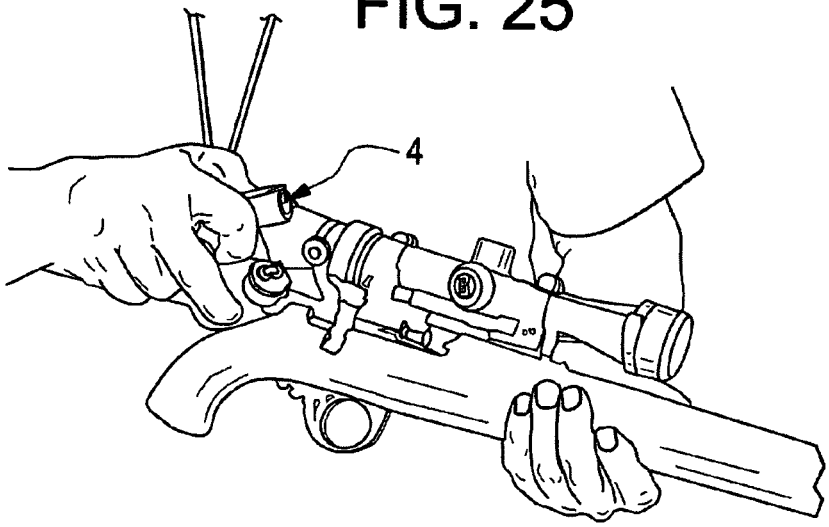
FIG. 25 shows the primer storage cavity cover being removed using thumb, exposing replacement primer and primer removal tool.

Once the bullet is firmly seated on top of the powder charge, the shooter withdraws and replaces the ramrod and then repositions the firearm 70 a shown in FIG. 24 to access and remove the spent primer. As shown in FIG. 25, while firmly holding the firearm in one hand the shooter again grasps the tool, this time with his thumb pointing toward the primer-tool end. Using the thumb, the shooter pushes the water resistant cap 44 off of the primer-tool end 4 of the invention.

Figure 26:
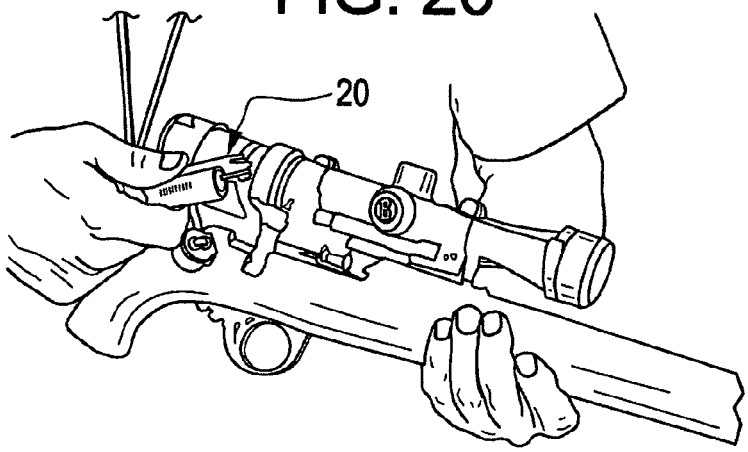
FIG. 26 shows the primer insertion and removal tool being extended with thumb.
Figure 27:
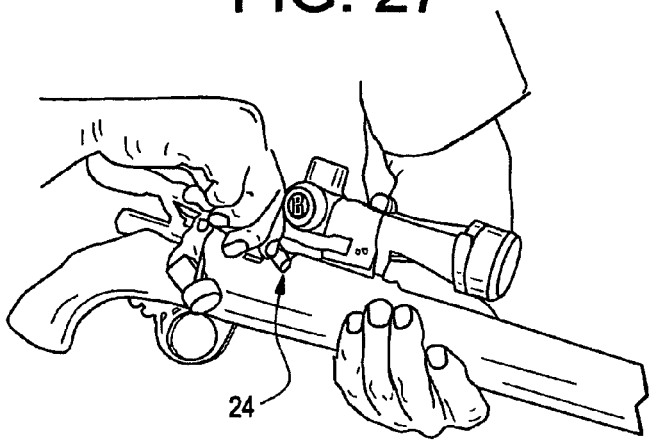
FIG. 27 shows primer removal tool forks prying out spent primer.
Figure 28:
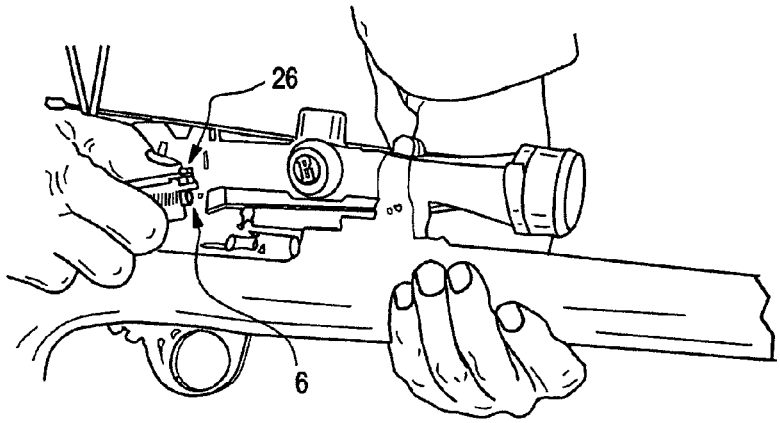
FIG. 28 shows spent primer being cleared from primer removal tool forks with thumb.
Figure 29:
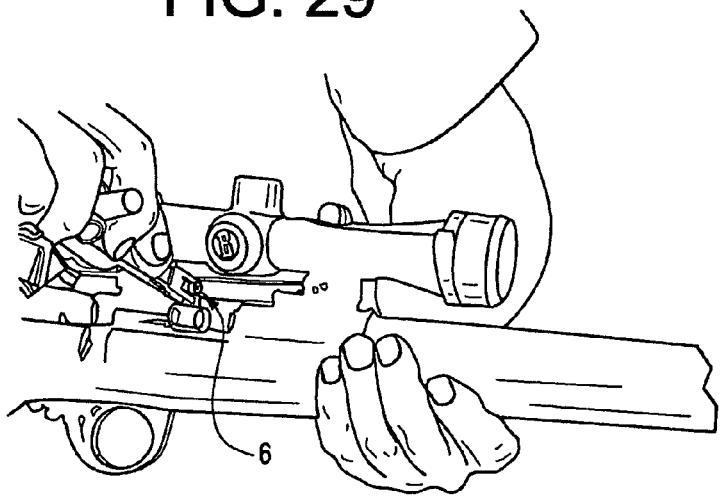
FIG. 29 shows the primer insertion and removal tool fully extended using thumb.
Figure 30:
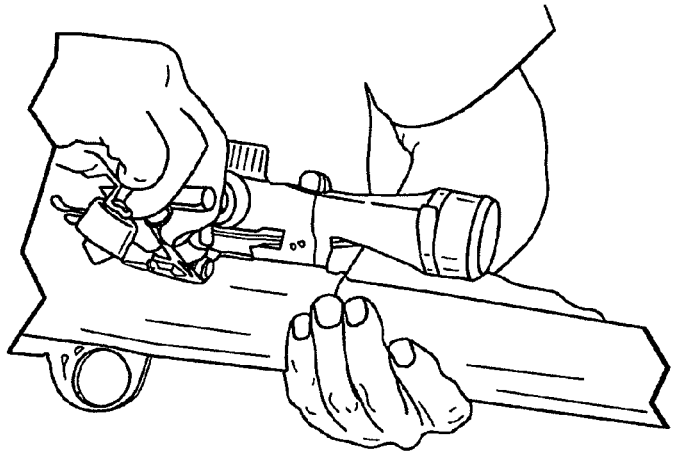
FIG. 30 shows new primer being inserted into primer nipple at beach end of rifle.
Figure 31:
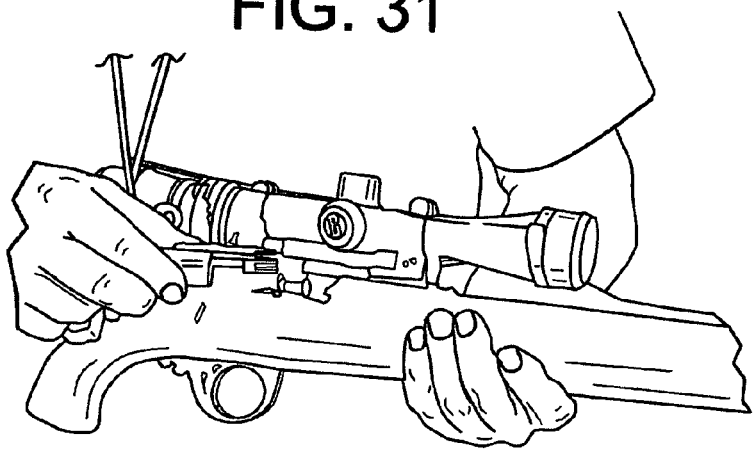
FIG. 31 shows the primer tool being removed from rifle.
Figure 32:
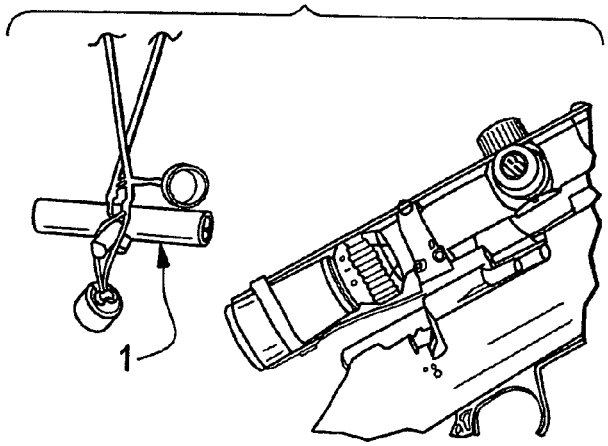
FIG. 32 shows the rifle ready to fire.

Again using the thumb, as shown in FIG. 25, the shooter extends the primer removal and insertion tool 20 sufficiently to expose the primer tool end as shown in FIG. 26. Utilizing the top side 22 and fork 24 of the primer tool 20, the shooter then pries the spent primer from its seat as shown in FIG. 27. Once the spent primer is removed, the shooter simply rotates his wrist 180 degrees and inserts the replacement primer 6, which has been neatly stored in primer retainer insertion side 26 of the primer tool, thus completing the muzzle loader reloading process as shown in FIGS. 28-32.

One exemplary embodiment of the invention has been shown and described. It will be apparent to those skilled in the art that changes and modifications may be made therein without departing from the spirit of the invention.

Accordingly, the foregoing description of the exemplary embodiments of the invention, as set forth above, are intended to be illustrative, not limiting. Various changes, modifications, and/or adaptations may be made without departing from the spirit and scope of this invention.

While the invention has been described with reference to specific embodiments, modifications and variations of the invention may be constructed without departing from the scope of the invention, which is defined in the following claims.

I claim:

1. A multipurpose tool apparatus for a muzzle loading firearm, comprising:

an elongated body having first and second ends;

a first waterproof storage chamber for holding powder and a bullet in the first end;

a second waterproof storage chamber for holding a primer in the second end;

a primer retraction tool connected to the body at the second end;

a primer placement tool connected to the body at the second end;

first and second waterproof sealing lids for connecting to the body at the first and second ends, respectively;

a bullet starter tool connected perpendicularly to the body between the first and second ends;

a universal T-handle ramrod adapter connected perpendicularly to the body between the first and second ends; and a lanyard connected to the body and to the first and second end lids for retaining the body and end caps and preventing their loss.

2. The apparatus of claim 1, wherein the primer placement tool has a groove and slot at an outer end for holding a primer.

3. The apparatus of claim 2, wherein the primer placement tool is slidable within the second waterproof storage chamber for holding the primer placement tool and the primer in the second waterproof storage chamber.

4. The apparatus of claim 1, wherein the primer removal tool and the primer replacement tool are connected and are slidable with respect to the body to extend inward from the second end of the body when stored and to extend outward from the second end of the body when in operational position.

5. The apparatus of claim 4, wherein the second chamber has an elongated slot and the primer removal tool and the primer placement tool are connected by a guide extending through the slot.

6. The apparatus of claim 5, wherein the second lid has a portion which fits between outer ends of the primer removal tool and the primer replacement tool.

7. The apparatus of claim 1, further comprising lanyard receiving loops on the body and on the first and second lids.

8. The apparatus of claim 7, wherein the lanyard receiving loops are on a middle portion of the body and on outer ends of the lids.

9. The apparatus of claim 1, wherein the lids are friction sealed lids which are slidable in friction seal on the first and second ends of the body.

10. The apparatus of claim 1, wherein the bullet starter tool has an outer end having a bullet tip receiving recess.

11. The apparatus of claim 10, wherein the bullet starter tool and the universal T-handle adaptor are angularly positioned with respect to each other.

12. A method of loading a muzzle-loading firearm, comprising holding a barrel of the firearm with a first hand, holding a loading tool in a second hand, sliding a lid from one end of a loading tool with a thumb of the second hand, tipping the loading tool and pouring powder pellets and a bullet from a first storage chamber through a muzzle of the firearm, pushing the bullet into the barrel with a bullet starter extending from the loading tool, removing a ramrod from the firearm and pushing the bullet and the powder pellets with the ramrod, attaching a T-handle adaptor on the loading tool to the ramrod and pushing the tool with the second hand to drive the powder pellets and the bullet into a seat, moving the firearm to a position to expose a primer, removing a second lid from a second end of the tool with the thumb of the second hand, sliding a primer remover and primer placer holding a new primer outward of the second end of the tool, removing a spent primer with the primer remover, and placing the new primer in position in the firearm with the primer placer.

13. The method of claim 12, wherein all of the steps other than holding the firearm are carried out with the second hand of the user.

14. The method of claim 12, further comprising connecting the tool and the lids with a lanyard.

15. The method of claim 12, further comprising preparing the tool by placing the bullet and the powder pellets in the first storage chamber, capping the first chamber with the first lid, sliding the new primer in the primer placer, sliding the primer placer and the new primer into the second chamber, and capping the second chamber with the second lid.

* * * * *